United States Patent [19]

Iio et al.

[11] Patent Number: 4,615,663

[45] Date of Patent: Oct. 7, 1986

[54] COMPRESSOR WITH VANES MADE OF COMPOSITE MATERIAL INCLUDING CARBON, ALUMINUM, AND ALUMINUM CARBIDE

[75] Inventors: Masahiro Iio, Konan; Yasuhiko Saruwatari, Yokosuka; Hiroshi Yamazoe, Yokohama, all of Japan

[73] Assignees: Diesel Kiki Co., Ltd.; Nippon Carbon Co., Ltd., both of Tokyo, Japan

[21] Appl. No.: 716,709

[22] Filed: Mar. 27, 1985

[30] Foreign Application Priority Data

Mar. 29, 1984 [JP] Japan ..... 59-61642

[51] Int. Cl.[4] ..... F04C 18/00; F04C 29/00

[52] U.S. Cl. ..... 418/152; 418/83; 418/179

[58] Field of Search ..... 418/152, 179, 83; 501/87

[56] References Cited

U.S. PATENT DOCUMENTS

| | | | |
|---|---|---|---|
| 2,674,953 | 4/1954 | Conde | 418/152 |
| 3,335,944 | 8/1967 | Conde et al. | 418/152 |
| 4,500,360 | 2/1985 | Wakayama et al. | 418/152 |

FOREIGN PATENT DOCUMENTS

| | | | |
|---|---|---|---|
| 1581279 | 9/1969 | France | 418/152 |

*Primary Examiner*—John J. Vrablik

*Attorney, Agent, or Firm*—Wenderoth, Lind & Ponack

[57] ABSTRACT

This vane type compressor includes: a main body comprising a cylinder block formed with a bore and end members closing the ends of the bore; a rotor received within the main body in the bore so as to be rotatable about an axis extending in its longitudinal direction, its surface being formed with several slots extending in its longitudinal direction; and several vanes, each slidably fitted into one of the slots with its outer edge bearing against the inside surface of the bore in the main body. The material from which the vanes are formed is a composite material, comprising carbon and a metal including a substantial proportion of aluminum, and further including a substantial quantity of aluminum carbide, which holds the composite material together well and prevents the metal from coming away therefrom. This aluminum carbide may lie between the carbon and the reinforcing metal, and may be in a quantity of from about 1% to about 20%. The rotor may be made from cast iron, or from a material which has a similar coefficient of thermal expansion to the material for the vanes; this means that the vanes always fit well into the slots, no matter what may be the operating temperature of the compressor.

2 Claims, 5 Drawing Figures

COMPRESSOR WITH VANES MADE OF COMPOSITE MATERIAL INCLUDING CARBON, ALUMINUM, AND ALUMINUM CARBIDE

BACKGROUND OF THE INVENTION

The present invention relates to the field of vane type compressors for compressing a gas such as a coolant gas, and in particular relates to an improvement in such vane type compressor which utilizes an improved material for the vanes thereof.

A vane type compressor generally comprises a cylinder block which is formed with a cylindrical bore, typically circular or elliptical, and end walls closing off this cylinder bore. A cylindrical rotor is received in the cylinder bore, with its axis parallel to or coincident with the axis of the bore, and a plurality of vanes are fitted into longitudinal slots formed in a generally radial direction in this rotor. As the rotor is rotated, a plurality of chambers are defined by these vanes as their outer edges slide against the wall of the bore, being biased thereagainst by the action of centrifugal force and possibly by the pressure of lubricant. As these chambers rotate around the cylinder bore, they expand and contract according to the particular configuration of the rotor and the bore, and by the provision of appropriate valving means these chambers are caused to perform compression and pumping of working fluid.

Conventionally, a type of material that has been utilized for these vanes has been cast high silicon aluminum alloy, which is light and wear resistant. However, this type of vane in some circumstances has a tendency to wear out rapidly, due to lack of lubricant when the lubricant layer on the tip edge portion of the vane fails as this tip edge slides over the surface of the cylinder bore, or when the lubricant layer between the side surfaces of the vane and the side surfaces of its slot in the rotor fails. This type of lubricant layer failure can particularly occur in the low speed high load operational condition.

Accordingly, in Japanese Patent Publication Ser. No. Sho. 58-77192, which it is not hereby intended to admit as prior art except to the extent otherwise prescribed by law, it was proposed to make the vanes for such a compressor from a material which was manufactured by impregnating a carbon preform with low melting point metal, such as aluminum or aluminum alloy, so that the self lubricating property of carbon should be combined with the strength of metal. However, this material is not completely satisfactory, because the bond between the carbon and the impregnating metal is typically not sufficiently strong, and accordingly the wear resistance of the vane is not found to be adequate, particularly since the vane is subjected to both heat and stress as it compresses the working fluid. Thus, prior art vane type compressors have left much to be desired with regard to the performance of the vanes thereof.

SUMMARY OF THE INVENTION

Accordingly, it is the primary object of the present invention to provide a vane type compressor which does not have the above described shortcomings.

It is a further object of the present invention to provide such a vane type compressor which has vanes which have good wear resistance.

It is a further object of the present invention to provide such a vane type compressor which has vanes which have no tendency towards dissolution of the material thereof.

It is a further object of the present invention to provide such a vane type compressor which is not particularly liable to lubricant film failure.

It is a further object of the present invention to provide such a vane type compressor which has a self lubricating property.

It is a yet further object of the present invention to provide such a vane type compressor which is durable as a whole.

It is a yet further object of the present invention to provide such a vane type compressor which has vanes made of a composite material including carbon and metal, in which the metal is not liable to detach from the vanes due to insufficient bonding between the carbon and the metal.

It is a yet further object of the present invention to provide such a vane type compressor which is durable at substantially all conditions of operating temperature.

It is a yet further object of the present invention to provide such a vane type compressor which maintains a good fitting between the vanes thereof and the slots in its rotor in which said vanes are fitted.

It is a yet further object of the present invention to provide such a vane type compressor with vanes which can be conveniently and economically manufactured.

According to the most general aspect of the present invention, these and other objects are accomplished by a vane type compressor, comprising: (a) a main body comprising a cylinder block formed with a bore and end members closing the ends of said bore; (b) a rotor received within said main body in said bore thereof so as to be rotatable about an axis extending in its longitudinal direction, its surface being formed with a plurality of slots extending in its said longitudinal direction; and (c) a plurality of vanes, each slidably fitted into one of said slots with its outer edge bearing against the inside surface of said bore in said main body; (d) wherein the material from which said vanes are formed is a composite material, made up from carbon and a metal including a substantial proportion of aluminum, and further comprising a substantial quantity of aluminum carbide.

According to such a structure, this aluminum carbide helps in securing the metal, which acts as a reinforcing material and provides mechanical strength, to the vanes. Thus, the metal is not liable to detach from the vanes due to insufficient bonding between the carbon and the metal. Thereby, these vanes have good wear resistance, and have no tendency towards dissolution of the material thereof. Also, this vane type compressor is not particularly liable to lubricant film failure, because the vanes thereof contain carbon, which has a self lubricating property. Thus, this compressor as a whole is durable.

Further, according to a more particular aspect of the present invention, these and other objects are more particularly and concretely accomplished by a vane type compressor of the type described above, wherein, in said material for said vanes, said aluminum carbide is situated between the carbon and the aluminum containing metal thereof. This means that the aluminum carbide is ideally situated for reinforcing the vanes as explained above. Further, the proportion of aluminum carbide in said material for said vanes may desirably be between about 1% and about 20%.

Yet further, according to a yet more particular aspect of the present invention, these and other objects are yet more particularly and concretely accomplished by a vane type compressor of the type described above, wherein said rotor is made from cast iron, or is made from a material which has a similar coefficient of thermal expansion to said material for said vanes.

According to such a structure, since such material has a similar coefficient of thermal expansion to said material for said vanes, good fitting is maintained between the vanes and the slots in the rotor in which said vanes are fitted, at substantially all conditions of operating temperature.

Also, as will be explained later, such a material as described above for the vanes can be conveniently and economically manufactured.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all given purely for the purposes of explanation and exemplification only, and none are intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are, in all cases, to be understood in terms of the relevant figure; and:

DESCRIPTION OF THE PREFERRED EMBODIMENT

Figure 1:
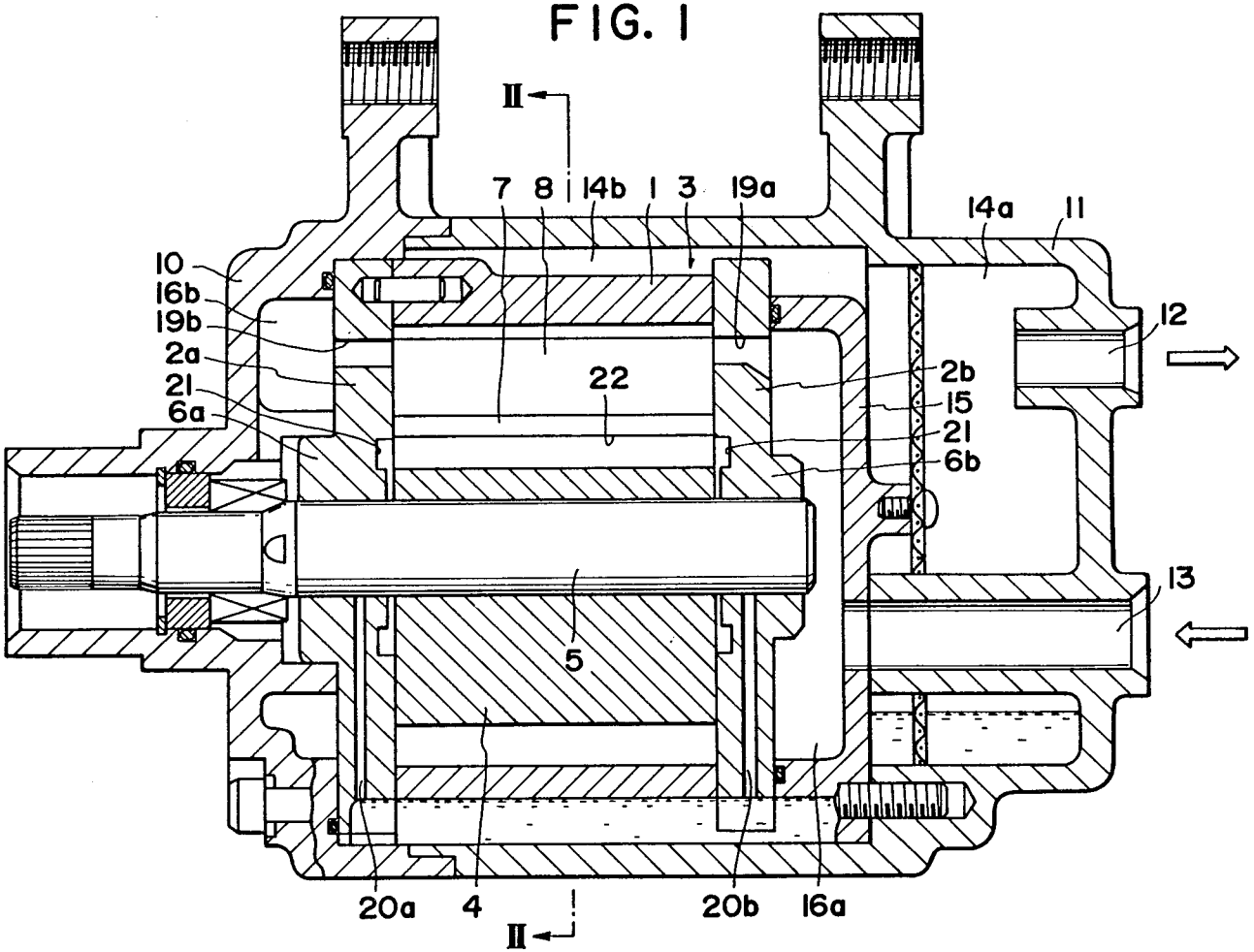
FIG. 1 is a longitudinal sectional view of the preferred embodiment of the vane type compressor of the present invention.
Figure 2:
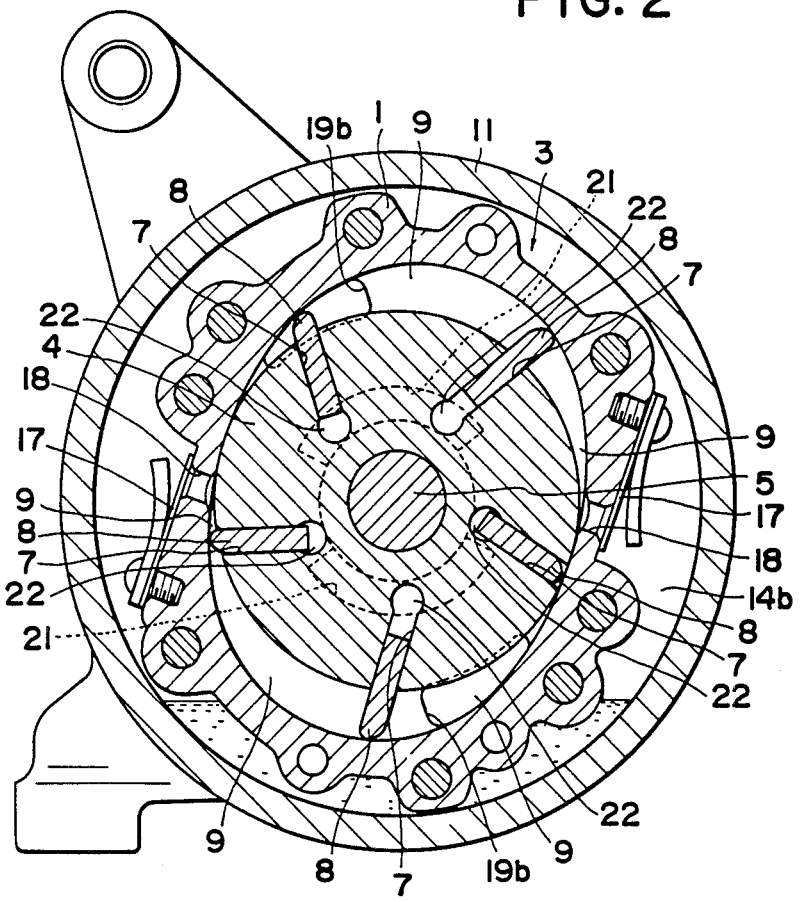
FIG. 2 is a transverse cross sectional view of said preferred embodiment, taken in a plane shown by the arrows II—II in FIG. 1.

The present invention will now be described with reference to the preferred embodiment thereof, and with reference to the appended drawings. FIG. 1 is a longitudinal sectional view of said preferred embodiment of the vane type compressor according to the present invention, and FIG. 2 is a transverse cross sectional view thereof taken in a plane shown by the arrows II—II in FIG. 1. In these figures, the reference numeral 1 denotes a cylinder block which is a main member of the compressor and is formed with a longitudinal bore which has an elliptical cross section, as best seen in FIG. 2. To the front end of the cylinder block 1 (the left end thereof as seen in FIG. 1) there is fixed a front end plate member 2*a*, and to the rear end of said cylinder block 1 (the right end thereof as seen in FIG. 1) there is fixed a rear end plate member 2*b*; thus, the ends of the bore in the cylinder block 1 are closed, with the exception of certain small apertures in said end plate members 2*a* and 2*b* which will be described hereinafter. The combination of the cylinder block 1 and the end plate members 2*a* and 2*b* constitutes a compressor main body assembly 3.

Within the elliptical cross section cavity of this compressor main body assembly 3 there is received a cylindrical rotor 4, the central axis of which is coincident with the axis of symmetry of said cavity, and the diameter of which (see FIG. 2) is substantially equal to the minor axis of said elliptical cross section. This rotor 4 is fixedly mounted on a drive shaft 5, the central axis of which is also coincident with the axis of symmetry of said cavity of said assembly 3, and which is rotatably mounted in bosses 6*a* and 6*b* formed at the central points of the end plate members 2*a* and 2*b*; this rotatable mounting may also incorporate bearing means such as roller bearings in the bosses 6*a* and 6*b*, but none are shown in the figures. The front end (on the left as seen in FIG. 1) of this drive shaft 5 is adapted to be rotatably driven by a belt and pulley means or the like, not shown, when the compressor is in use.

The rotor 4 in this preferred embodiment is made of cast iron, although the use of other materials therefor is possible. As best seen in FIG. 2, there are formed in this rotor 4 five slots 7 which open from the circumferential cylindrical surface of said rotor 4. Each of these slots 7 is formed generally as a thick plane, extending in its longitudinal direction along the longitudinal direction of the rotor 4 (i.e. containing a generator of its cylindrical surface) completely along it, and extending in its depth direction towards the central axis of the rotor 4 at a slight inclination, so as not to contain said central axis of said rotor 4 but to be parallel thereto. And the bottom of each of these slots 7 is formed as a tubular chamber 22, of somewhat greater diameter than the width of the slot 7 and extending in the longitudinal direction of the rotor 4 completely along it. And in each of these slots 7 there is received a vane 8, which is generally formed as an elongated rectangular plate with thickness substantially equal to the width of said slots 7 and with length substantially equal to the length of the rotor 4. However, the outward long tip edge of each of these vanes 8 is formed in a curved shape, as shown in FIG. 2. The composite material of which these vanes 8 are formed will be more particularly specified later herein. As will also be explained hereinafter, each of the vanes 8 is biased in the radially outward direction in its slot 7 and is slid outwards and inwards in said slot 7 as the rotor 4 and the vanes 8 rotate, so that the tip edge of said vane 8 is always kept in contact with the elliptical cylindrical inner surface of the bore of the cylinder block 1. Thus, five compression chambers 9 are defined by the five adjacent pairs of the vanes 8, in cooperation with the rotor member 4, the cylinder block 1, and the two end plate members 2*a* and 2*b* of the compressor main body assembly 3, and, as the rotor 4 and the vanes 8 rotate, these five compression chambers 9 expand and contract in turn.

Referring to FIG. 1, the compressor main body assembly 3 is surrounded by an outer shell assembly within which it is fixed, comprising a tubular shell 11 formed generally as a tube with one open end and one closed end, and a head 10, to which the end plate member 2*a* is fixed, fitted into said open end of said tubular shell 11. The closed end of the tubular shell 11 is formed with an output port 12 and an input port 13, and the output port 12 is communicated to a high pressure output plenum 14*a* which is defined within the closed end portion of the tubular shell 11, while the input port 13 is communicated to a first low pressure input plenum 16*a* located at the rear end of the compressor, which is defined within a cover member 15 mounted within said closed end portion of the tubular shell 11, in order to separate said first input plenum 16*a* from said output plenum 14*a*. Further, via a passage which is not shown in the figures, this first low pressure input plenum 16*a* is connected to a second low pressure input plenum 16*b* located at the front end of the compressor, which is defined within the head portion 10 of the outer shell assembly thereof. And also an extension 14*b* of the output plenum 14*a* surrounds the sides of the cylinder block 1.

Two outlet ports 18 (see FIG. 2) are provided approximately at diametrically opposite positions on the sides of the cylindrical shape of the cylinder block 1, thus opening into opposite sides of the elliptical bore formed therein, at points near the ends of the minor axis thereof. And two outlet valves 17 control flow through these outlet ports 18, each of which functions so as to only allow flow of fluid from the compression chamber 9 to which its outlet port 18 is currently communicating past said outlet valve 17 to said extension 14*b* of the outlet plenum 14*a* surrounding the sides of said cylinder block 1, and not in the reverse direction. And two respective inlet ports 19*a* and 19*b* open from the first and second input plenums 16*a* and 16*b* through each of the respective end plate members 2*a* and 2*b*, the two such inlet ports of each pair again opening approximately at diametrically opposite positions on the generally elliptical end shape of the respective one of the end plate members 2*a* and 2*b*. Thus, when one of the compression chambers 9 is communicated to a one 19*a* and a one 19*b* of these inlet ports at its opposite ends, at which time said compression chamber 9 is expanding as the rotor 4 and the vanes 8 rotate in the clockwise direction as shown in FIG. 2, fluid is sucked from the first and second low pressure plenums 16*a* and 16*b* into said compression chamber 9 through said inlet ports 19*a* and 19*b*. The lower parts of the high pressure output plenums 14*a* and 14*b* serve as a lubricant sump, and lubricant which has collected in this lubricant sump is supplied under the pressure in these high pressure output plenums 14*a* and 14*b*, via passages 20*a* and 20*b* formed in the end plate members 2*a* and 2*b*, via grooves (not particularly shown) formed on the bearing surfaces of the boss portions 6*a* and 6*b*, and via depressed shapes 21 formed on the inwardly facing surfaces of said end plate members 2*a* and 2*b*, to the aforementioned tubular chambers 22 extending along the bottoms of each of the slots 7 in the rotor 4. This pressurized lubricant in the tubular chambers 22 serves to provide some biasing action for the vanes 8 which are fitted in the slots 7, to bias said vanes 8 in the radially outward direction as mentioned previously so as to keep their tip edges in contact with the elliptical cylindrical inner surface of the bore of the cylinder block 1 (and further biasing effect in the radially outward direction is provided for said vanes 8 by the action of centrifugal force); and said lubricant further serves for lubricating the frictional rubbing contact between the sides of said vanes 8 and the sides of their respective slots 7, and also for lubricating the frictional rubbing contact between said tip edges of said vanes 8 and said elliptical cylindrical inner surface of the bore of the cylinder block 1.

Thus, during the operation of this compressor, as the rotor 4 is rotated via the shaft 5 in the clockwise direction as seen in FIG. 2, to consider one of the pairs 19*a* and 19*b* of inlet ports and a particular one of the vanes 8, as said vane 8 in its turn passes said inlet ports 19*a* and 19*b* with its side edges, the compression chamber 9 between this particular vane 8 and the next trailing one of the vanes 8 comes to be communicated to said inlet ports 19*a* and 19*b*, and at this time said compression chamber 9 is substantially at its minimum volume. As the rotor 4 and the vanes 8 are further rotated, said compression chamber 9 expands in volume, and thus fluid is sucked from the input port 13 into the first and second low pressure input plenums 16*a* and 16*b* and thencefrom through the inlet ports 19*a* and 19*b* into said compression chamber 9. At the approximate instant that said compression chamber 9 attains its maximum volume, the next one of the vanes 8 comes to interrupt communication between said compression chamber 9 and the inlet ports 19*a* and 19*b* with its side edges; and thereafter as this compression chamber 9 shrinks in volume the fluid in it is compressed. And when this particular one of the vanes 8 which is the forward one of the vanes 8 defining this compression chamber 9 passes past the next one of the outlet ports 18 around the circumference of the bore of the cylinder block 1, the compressed fluid in this compression chamber 9 is ejected through this outlet port 18, past the controlling valve 17 therefor, into the high pressure output plenum 14*b*, whence said compressed fluid flows into the other high pressure output plenum 14*a* and out through the output port 12 of the compressor. And as the rotation of the rotor 4 and the vanes 8 continues this particular one of the vanes 8 starts on another compression cycle.

In this connection, considering this point in the cycle where the vanes 8 pass the outlet port 18, if at this time the tubular chamber 22 at the base of this vane 8 is communicated via the depressed shapes 21 and the passages 20*a* and 20*b*, etc., to the high pressure output plenums 14*a* and 14*b*, then the vane 8 will be centripetally withdrawn as the edge thereof passes the outlet port 18, and the tip edge portion thereof will then abruptly hit the internal surface of the bore of the cylinder block 1 as said vane commences its next compression stroke, thereby developing the so called chattering phenomenon, which is very disadvantageous for the performance and also for the durability of the compressor. However, according to the shown structure of the preferred embodiment of the compressor of the present invention, and in particular due to the particular shapes adopted for the depressed shapes 21 formed on the inward surfaces of the end plate members 2*a* and 2*b*, the tubular chamber 22 becomes isolated from the passages 20*a* and 20*b* and the plenums 14*a* and 14*b*, and becomes sealed, at this point in its cycle, and accordingly at this time when said vane 8 passes the outlet port 18 the pressure of its tubular chamber 22 is maintained, thus preventing the chattering phenomenon by keeping the tip edge portion of said vane 8 constantly pressed against the internal surface of the bore of the cylinder block 1 by a high pressure.

Now, the material of which the vanes 8 are manufactured will be described. This is a carbon composite material of a carbon - aluminum (or aluminum alloy) - aluminum carbide type, and a way in which a preferred form of it was made was as follows.

First, finely pulverized carbon was pressure formed, and was baked into a carbon preform at a temperature of about 800° C. to about 1500° C. The pressure of this pressure forming was so controlled as to leave a porosity of about 30% to about 38% in the carbon preform. Next, an autoclave was charged with this carbon preform along with a quantity of an alloy of aluminum (but it is envisaged that pure aluminum would also be suitable), and the interior of said autoclave was exhausted of air down to a pressure of about 10 mmHg to 2 mmHg or lower, so as to exhaust the gas trapped in the pores of the carbon preform. And then the aluminum alloy in the autoclave was melted by being heated to a temperature of about 650° C., and the carbon preform was immersed in the molten aluminum alloy while they were still being kept in the autoclave, and then a quantity of inert gas such as argon was charged into the autoclave above the surface of the molten aluminum alloy and was pressurized to a temperature of 30 kg/cm$^2$ (a higher pressure is thought to be even more suitable), so that the molten aluminum alloy was forced to infiltrate into the interstices of the carbon preform. Further, the pressurization condition was maintained for a time of several minutes, so as to cause and to allow time for the molten aluminum alloy to react with the carbon of the carbon preform to form aluminum carbide; and then the mass of composite material was allowed to cool. When samples of this type of material made under various combinations of conditions were tested, their content of aluminum carbide was found to range between 1% and 20% by volume, and to particularly be situated between the carbon portions of said samples and the reinforcing aluminum or aluminum alloy metal thereof.

Figure 3:
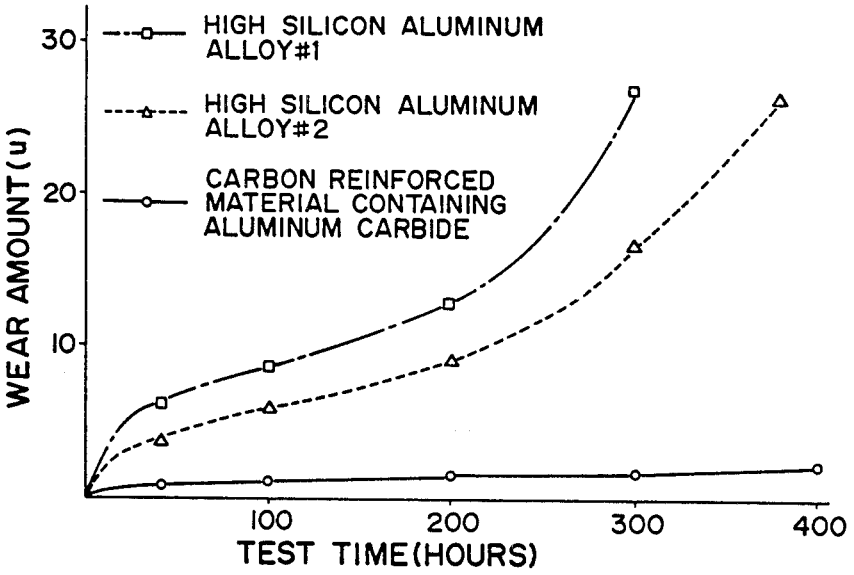
FIG. 3 is a graph, in which testing time in hours is shown along the horizontal axis and vane wear amount in microns is shown along the vertical axis, giving the results of tests performed on a vane manufactured from a carbon - aluminum alloy - aluminum carbide composite material by fitting it to a compressor, in comparison with the like performances of two vanes made from conventional materials of the high silicon aluminum alloy type.

In FIG. 3, which is a graph in which testing time in hours is shown along the horizontal axis and vane wear amount in microns is shown along the vertical axis, there are given the results of tests performed on a vane manufactured from a composite material manufactured in such a manner as described above when it was fitted to such a compressor as described previously, in comparison with the like performances of two vanes made from conventional materials of the type described in the portion of this specification entitled "Background of the Invention" including high silicon aluminum alloy. The high silicon aluminum alloy number 1 used for comparison purposes in this study contained 11% to 12% of silicon, while the high silicon aluminum alloy number 2 contained about 20% of silicon; and the carbon - aluminum - aluminum carbide material used for the vane for the compressor of the present invention in this particular case contained 20% to 40% of aluminum. The operating conditions for the compressor in each case were: overloading operation with continuous operation at about 600 rpm, an output side delivery pressure of 30 kg/cm$^2$, and an intake side suction pressure of 4 kg/cm$^2$. It will be understood from these results that the performance of the vane of the compressor of the present invention, and of the compressor as a whole, was very much improved over the prior art.

Figure 4:
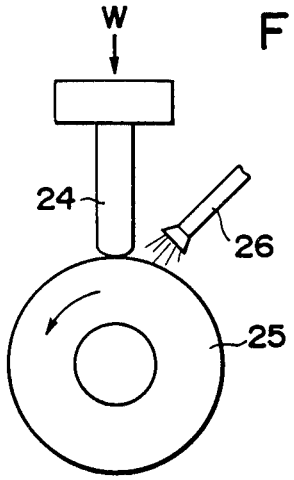
FIG. 4 is a schematic transverse sectional view illustrating an experimental setup used during certain drum type wear tests performed on certain vane test samples.

Further, FIG. 4 is a schematic transverse sectional view illustrating the experimental setup used during certain drum type wear tests which were also performed on five test examples of each of the three vanes made as described above with regard to the FIG. 3 test. In detail, in turn each test sample vane, denoted as 24 in FIG. 4, was pressed in the radial direction against the circumference of a test drum 25 by a weight W, while lubricant was sprayed onto the drum surface through a nozzle 26. The pressure used was in each case about 4 kg/mm in the longitudinal direction of the test vane 24, while the lubricant was of the type "Suniso 5GS" (this is a trademark) at a temperature of 100° C. and was supplied at the rate of 300 cm$^3$/min. In each case, the cumulative distance of travel of the surface of the drum 25 was set as being 200 km, while the circumferential speed of travel of said surface of the drum 25 was variously set as being 1 m/sec, 3 m/sec, 5 m/sec, 7 m/sec, and 10 m/sec.

Figure 5:
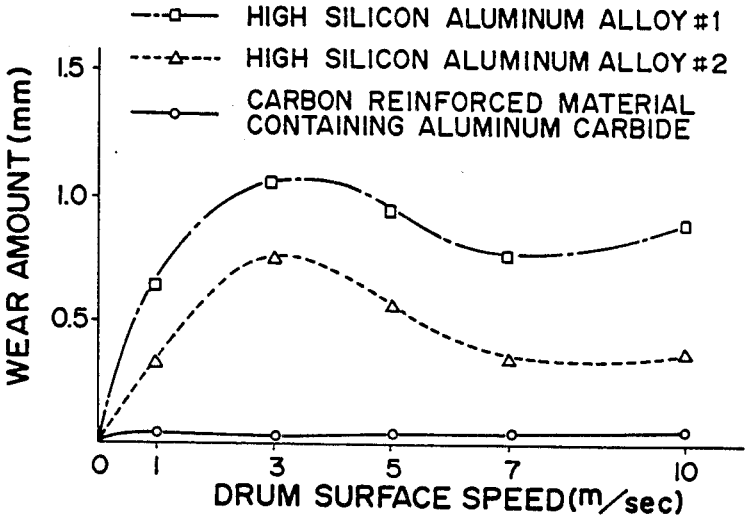
FIG. 5 is a graph, in which circumferential speed of a test drum of FIG. 4 is shown along the horizontal axis, and wear amount in millimeters along the width dimension of each test sample vane is shown along the vertical axis, again relating to vanes manufactured from carbon - aluminum alloy - aluminum carbide composite material in comparison with vanes made from conventional materials of the high silicon aluminum alloy type.

The results of these drum type wear tests are shown in FIG. 5, which is a graph in which circumferential speed of the drum 23 is shown along the horizontal axis and wear amount in millimeters along the width dimension of each test sample vane is shown along the vertical axis. Again from these results it will be understood that the wear performance of the vanes made from the carbon - aluminum - aluminum carbide material used for the vanes for the compressor of the present invention very much improved over the performances in like test circumstances of the vanes made from the prior art type materials 1 and 2.

As can clearly be seen from these test results, this carbon - aluminum - aluminum carbide composite material used for the vanes of the compressor of the present invention is far superior to the prior art materials used for such vanes, by a factor of even twenty to one in the case of low speed high load operation. This is thought to be because the bond between the carbon and the reinforcing aluminum or aluminum alloy impregnating metal is strong because of the aluminum carbide formed between them, and therefore the falling off of the aluminum reinforcing metal is effectively prevented. Thus, it is thought that the self lubricating property of carbon, as well as the mechanical strength and the wear resistance of the impregnating aluminum or aluminum alloy metal are both well and fully exploited, thereby giving the composite material superior mechanical strength and wear resistance qualities at high temperature.

As a further important good feature of the present invention, it is to be noted that the rotor 4 in the shown compressor according to the preferred embodiment of the present invention was made of cast iron. Since the carbon - aluminum - aluminum carbide composite material used for the vanes of the shown compressor has a coefficient of thermal expansion which is quite similar to that of such cast iron (the thermal expansion coefficient of carbon is low, while that of aluminum or aluminum alloy is quite high), thereby the vanes 8 and the rotor 4 have quite similar thermal expansion properties. Accordingly, the clearance between the vanes 8 and the slots 7 in the rotor 4 may be maintained fairly constant, irrespective of the particular degree of heating up of the compressor caused by its fluid compression operation at various duty levels.

Thus, it is seen that according to the present invention the aluminum carbide helps in securing the aluminum containing metal, which acts as a reinforcing material and provides mechanical strength, to the vanes.

Thus, the aluminum containing metal is not liable to detach from the vanes due to insufficient bonding between the carbon and the metal. Thereby, the vanes have good wear resistance, and have no tendency towards dissolution of the material thereof. And this vane type compressor is not particularly liable to lubricant film failure, because the vanes thereof contain the carbon, which has a self lubricating property, thus as a whole being durable. Because, in the material for the said vanes, the aluminum carbide is situated between the carbon and the aluminum containing metal thereof, this means that the aluminum carbide is ideally situated for reinforcing the vanes as explained above. Further, as described above, the proportion of aluminum carbide in said material for said vanes is between about 1% and about 20% which is very suitable. And, because the rotor is made from cast iron, or is made from a material which has a similar coefficient of thermal expansion to the material for the vanes, good fitting is maintained between the vanes and the slots in the rotor in which said vanes are fitted, at substantially all conditions of operating temperature. And, as has been explained, such a material as described above for the vanes can be conveniently and economically manufactured. It should be noted that the present invention is particularly effective when applied to a compressor of the type shown in the foregoing which has five vanes, because such a compressor involves a relatively high back pressure.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A vane-type compressor, comprising:

(a) a main body comprising a cylinder block formed with a bore and end members closing the ends of said bore;

(b) a rotor received within said main body in said bore thereof so as to be rotatable about an axis extending in its longitudinal direction, its surface being formed with a plurality of slots extending in its said longitudinal directions; and (c) a plurality of vanes, each slidably fitted into one of said slots with its outer edge bearing against the inside surface of said bore in said main body;

(d) wherein the material from which said vanes are formed is a composite material, comprising carbon and a metal including a substantial proportion of aluminum, and further comprising a substantial quantity of aluminum carbide;

said aluminum carbide being situated between the carbon and the aluminum containing metal thereof; the porportion of aluminum carbide in said material for said vanes being between about 1% and about 20%, and said rotor being made from a material which has a similar coefficient of thermal expansion to said material for said vanes.

2. The vane-type compressor according to claim 1 wherein said rotor is made of cast iron.

* * * * *